US005522674A

United States Patent [19]

Cooper

[11] Patent Number: 5,522,674

[45] Date of Patent: Jun. 4, 1996

[54] SELF-INFLATABLE CONTAINMENT BOOM AND METHOD OF MAKING

[75] Inventor: Samuel D. Cooper, Katy, Tex.

[73] Assignee: American Boat and Skimmer Company, Houston, Tex.

[21] Appl. No.: 447,014

[22] Filed: May 22, 1995

[51] Int. Cl.[6] ..... E02B 15/06

[52] U.S. Cl. ..... 405/63.000; 210/242.1; 405/66; 405/69; 405/70; 405/72

[58] Field of Search ..... 405/63, 66, 69, 405/68, 70, 71, 72; 210/242.1, 242.3

[56] References Cited

U.S. PATENT DOCUMENTS

| | | | |
|---|---|---|---|
| 3,499,290 | 3/1970 | Smith | 405/72 |
| 3,653,213 | 4/1972 | Childers . | |
| 3,708,982 | 1/1973 | Blockwick . | |
| 3,798,911 | 3/1974 | Oberg . | |
| 3,818,708 | 6/1974 | Benson | 405/70 X |
| 3,849,989 | 11/1974 | Preus | 405/70 X |
| 3,919,847 | 11/1975 | Ballu . | |
| 3,935,690 | 2/1976 | Lea et al. . | |
| 4,030,304 | 6/1977 | West | 405/70 |
| 4,068,478 | 1/1978 | Meyers et al. . | |
| 4,188,155 | 2/1980 | Langermann | 405/63 |
| 4,244,819 | 1/1981 | Ballu | 210/242.3 |
| 4,295,755 | 10/1981 | Meyers | 405/66 |
| 4,329,747 | 5/1982 | Russell | 5/420 |
| 4,652,173 | 3/1987 | Kallestad | 405/69 |
| 4,711,067 | 12/1987 | Magni | 53/439 |
| 4,802,791 | 2/1989 | Fisher et al. | 405/63 |
| 4,930,171 | 6/1990 | Frantz | 5/450 |
| 4,960,304 | 10/1990 | Frantz | 297/284 |
| 5,173,008 | 12/1992 | Thorell et al. | 405/68 |
| 5,201,607 | 4/1993 | Whidden, Jr. | 405/68 |
| 5,238,327 | 8/1993 | Blair et al. | 405/70 X |
| 5,308,191 | 5/1994 | Goans | 405/68 |
| 5,317,770 | 6/1994 | Sakurai | 5/625 |
| 5,362,180 | 11/1994 | Canning et al. | 405/66 |

FOREIGN PATENT DOCUMENTS

| | | | |
|---|---|---|---|
| 1243176 | 8/1971 | United Kingdom | 405/72 |
| 1413812 | 11/1975 | United Kingdom | 405/63 |

OTHER PUBLICATIONS

"Oil Containment Boom", ABASCO, Brochure #OCB 1100, Jan. 1994.

*Primary Examiner*—Stephen J. Novosad
*Attorney, Agent, or Firm*—Bush, Moseley, Riddle & Jackson

[57] ABSTRACT

A containment boom (10) includes a plurality of self-inflatable units (12) each having a plurality of chambers (26) connected end to end. Each chamber (26) has an air valve (28) at each end thereof. A water repellent and airtight covering (32) is provided for each chamber (26). A flotation subassembly (44) is positioned within an open space formed within the covering (32). The flotation subassembly includes a pair of open cell buoyant flotation members (54, 56) disposed on adjacent sides of an intermediate water repellent flotation member (58). The intermediate water repellent flotation member (58) is preferably formed of a closed cell polyethylene material and provides increased buoyancy to open cell flotation members (54, 56), particularly in the event that a rupture of the covering were to occur such that the open cell flotation members (54, 56) absorb water. The self-inflatable flotation members (54, 56) are compressed between 25% and 65% of their original volume and thus may be space efficiently stored for future deployment. The boom (10) may be coiled into a package for shipment or storage (FIGS. 7 and 8). When uncoiled with air valves (28) open, the boom self-inflates with air flowing to the open cell flotation members (54, 56) for expansion.

18 Claims, 3 Drawing Sheets

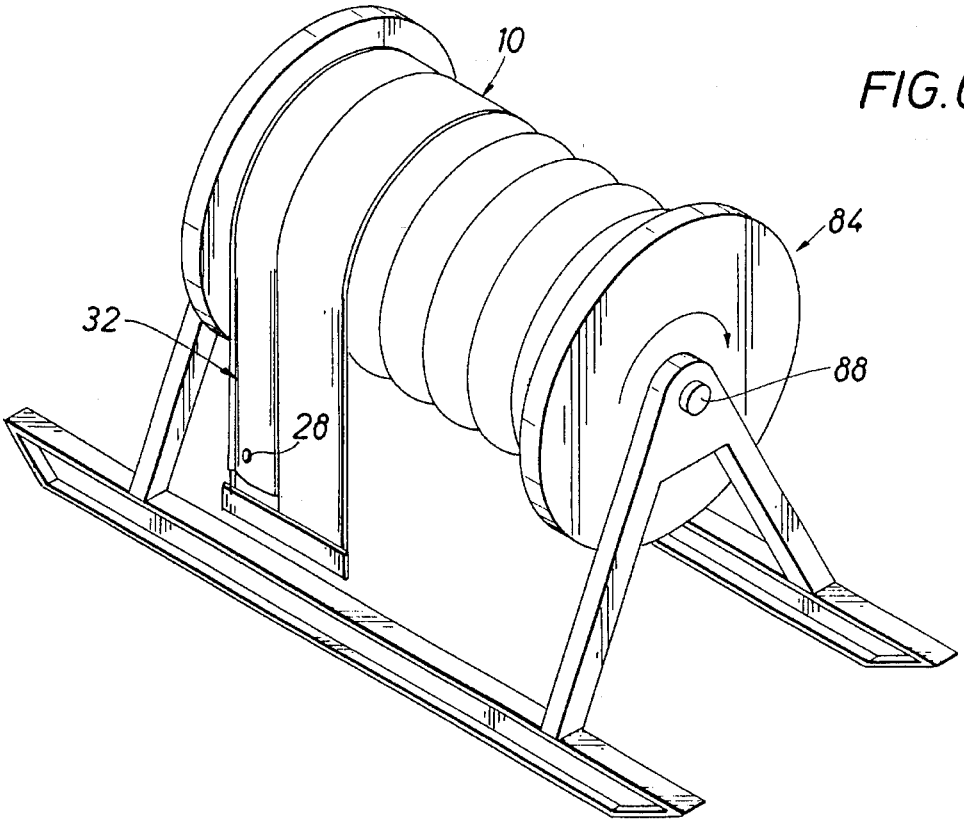
FIG. 6
FIG. 7
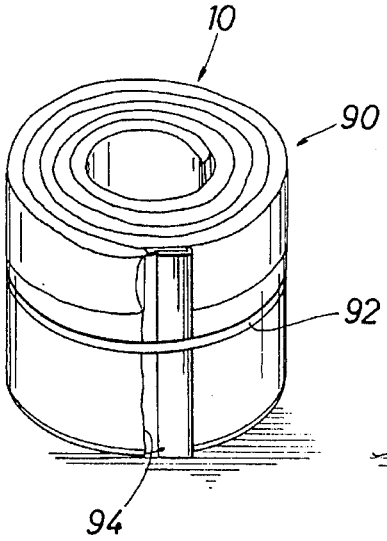
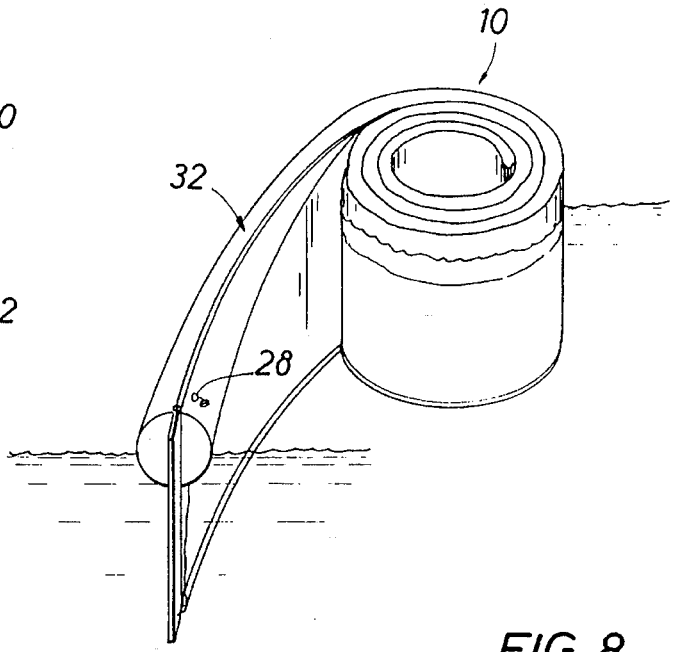
FIG. 8

SELF-INFLATABLE CONTAINMENT BOOM AND METHOD OF MAKING

FIELD OF THE INVENTION

This invention relates to a barrier containment boom, and more particularly to a self-inflatable containment boom and a method of making same.

BACKGROUND OF THE INVENTION

Heretofore, barrier containment booms such as oil booms have been provided for containment of oil spills and other contaminating material on the surface of a body of water. Such booms have normally included a buoyant flotation member having a cover with a skirt extending downwardly from the cover and ballast for the skirt to maintain the position of the boom in a body of water. Flotation members may have incompressible flotation material. Alternatively, booms may be compressible in order that they may be stored in a smaller space than those with incompressible flotation material.

Inflatable booms exist in which a buoyancy chamber is provided for applying pressurized air. An air valve is closed when the chamber is pressurized. The air valve is opened to evacuate the chamber and to store the boom in a coil or on a reel.

Self inflating booms exist in several forms which do not require the application of pressurized air to the buoyancy chamber. One boom exists in which springs are provided to inflate the boom via the atmosphere after it has been stored in an uninflated condition. An air intake valve is opened for inflation with the springs causing the cavity to expand partially. Air rushes into the cavity causing it to fully expand and provide flotation. The air intake valve is then closed to prevent water from entering the buoyancy chamber while the boom is deployed. When the boom is stored, it is rolled up or wound on a reel causing the springs to be compressed while air is forced out of the opened air valve. Such a boom may be stored in an uninflated condition by rolling it on a reel and providing a restraining strap or the like to prevent the springs from opening the boom. While effective for providing a boom which may be stored in a smaller space than with a boom with incompressible flotation material, self inflating booms with spring mechanisms are expensive and sometimes unreliable due to their mechanisms on which they rely for self inflation. Furthermore, if the buoyancy chamber of such booms were to be punctured or rupture, water entering a section of the boom causes such section to sink. U.S. Pat. No. 4,244,819 illustrates a self inflatable boom which may be compressed for storage on a reel and self inflated when unreeled.

A common incompressible flotation material for prior art incompressible containment booms has been closed cell polyethylene material as shown in U.S. Pat. No. 4,188,155 dated Feb. 12, 1980, for example. Other, buoyant flotation members have included other closed cell materials, such as polyurethane, polyphinachloride, and polystyrene all of which are water impermeable. Such materials may be coated with a material to make the cellular material water impermeable such as illustrated in U.S. Pat. No. 4,244,819 dated Jan. 13, 1981. Booms which rely solely on incompressible materials for flotation, while inexpensive to manufacture and will not sink, are nevertheless expensive in terms of their cost of storage space. They require relatively large storage space on a ship, boat or dock awaiting their use in an emergency.

While many of the buoyant flotation members for incompressible containment booms have been of a closed cell foam material so that they are impervious to water, U.S. Pat. No. 3,708,982 dated Jan. 9, 1973 shows a compressible, self inflatable containment boom in which an open cell polyurethane foam material is utilized as a buoyant flotation member in an upper section. To maintain buoyancy of the foam material, the foam material is made water impervious by sealing the outer periphery of the foam material by application of a surface coating material, such as an elastomer. Such surface coating prevents oil and the like from reaching the permeable foam material. A lower water absorbent material is secured to the porous upper section by a conventional water repellent sealing adhesive to prevent any fluid seepage from the lower section, which is submerged in the water, to the upper section. The submerged lower section entraps water to provide necessary ballast for the upper section. A polyurethane foam material when used for both the upper and the lower sections of the '982 patent may be compressed about 25% of its original volume to permit ease of transportation and storage. An air valve is provided to permit upper section inflation during expansion and to permit compression of the upper section during exhausting of the air for storage of the boom. The '982 boom section is likely to sink if the surface coating material is ruptured or punctured, because water will enter the open cell foam of the upper section thereby causing it to sink.

SUMMARY OF THE INVENTION

The present invention is directed to a self-inflatable containment boom or barrier formed of a plurality of separate units or modules detachably connected end-to-end with each unit including a plurality of connected sections, Each section has a pair of self-inflatable buoyant flotation members formed of an open cell material and arranged in a side-by-side relation, The pair of self-inflatable flotation members are positioned freely within a water repellent outer covering and are not secured to the covering. Each of the flotation members has an inner planar face and an outer face preferably formed of a plurality of protuberances and a plurality of intervening depressions thereby forming a relatively large void volume in the outer faces for facilitating compression of the flotation members.

Each section has a pair of air valves positioned adjacent opposite section ends and movable between open and closed positions. When an air valve is open, air enters or escapes the space within the covering for inflating or deflating the open cell flotation members. When the section is flattened for coiling, air is exhausted via the air valves, and the flotation members are compressed between approximately 25% to 65% of their original volume, preferably about 50% of their original volume. The air valves are then closed to prevent expansion of the flotation members while they are stored. Protuberances and depressions on the outer faces of the flotation members facilitate confining of a flotation member into a generally circular cross section when positioned within an outer cover and flattening of the boom when it is stored into a coil. Alternatively a reel may be provided for coiling of the self-inflatable boom thereon for storage, and for uncoiling the self-inflatable boom from the reel for deployment on a body of water. When a section is unreeled and the air valve is open, air enters the space within the covering for inflating the open cell flotation members.

While the outer covering is water repellent, damage such as punctures or ruptures may occur in the covering. As a result water may enter the space within the covering. The open cell flotation members will then absorb the water. While the open cell flotation members possibly may retain some amount of buoyancy even with the absorption of water, it is desirable to have a separate intermediate water repellent flotation member in addition to open cell flotation material for providing increased buoyancy. A water repellent flotation member is first secured between a pair of open cell flotation members in a preassembly, and then a covering is positioned over such preassembly without any direct securement to the preassembly. The intermediate water repellent flotation member is preferably a strip of a generally rectangular cross section and has a uniform thickness not less than about ½ inch. The thickness of the intermediate flotation member should not be excessive so that the boom may be easily coiled for storage. When in a deployed position, the strip has its width extending in a vertical direction between the inner faces of the pair of flotation members for increasing the buoyancy of the boom. The strip is lightweight, durable, and preferably formed of a closed cell foam material.

The method of forming a boom section includes the steps of inserting an intermediate flotation strip of a water impermeable material between a pair of flotation members formed of an open cell material, securing the intermediate strip to the pair of outer flotation members to form a subassembly, and then positioning an outer water repellent cover about the flotation subassembly.

A feature of this invention is the provision of a self-inflatable containment boom that includes a plurality of units removably connected end-to-end with each unit containing a flotation section having an outer water repellent cover with a flotation subassembly freely positioned within the cover. The flotation subassembly includes a pair of spaced open cell flotation members secured to an intermediate water impermeable flotation strip which increases the buoyancy of the open cell flotation members.

Another feature of the self-inflatable boom of this invention includes the utilization of a pair of open cell floatation members which have planar inner surfaces and opposed outer surfaces which includes projections and intervening depressions which facilitate the compressibility of the open cell flotation members when formed into a defined cross sectional shape. Such projections and depressions also facilitate the expansion of the open cell flotation members when self-inflated. Air valves at opposed ends of each section permit transfer of air between the atmosphere and the self-inflatable open cell flotation members during expansion and compression of the boom.

Other features and advantages of the invention will be more apparent after referring to the following specification and drawings.

BRIEF DESCRIPTION OF THE DRAWINGS

FIG. 6 is a perspective of a reel, for storing a boom in a coiled position and for uncoiling such boom for deployment into a body of water;

FIG. 7 is a perspective of a coiled boom packaged for storage and shipment;

FIG. 8 is a perspective of a coiled boom shown in FIG. 7 positioned within a body of water while it is self-inflating with air valves open for uncoiling of the boom in a body of water.

DESCRIPTION OF THE INVENTION

Figures 1, 5:
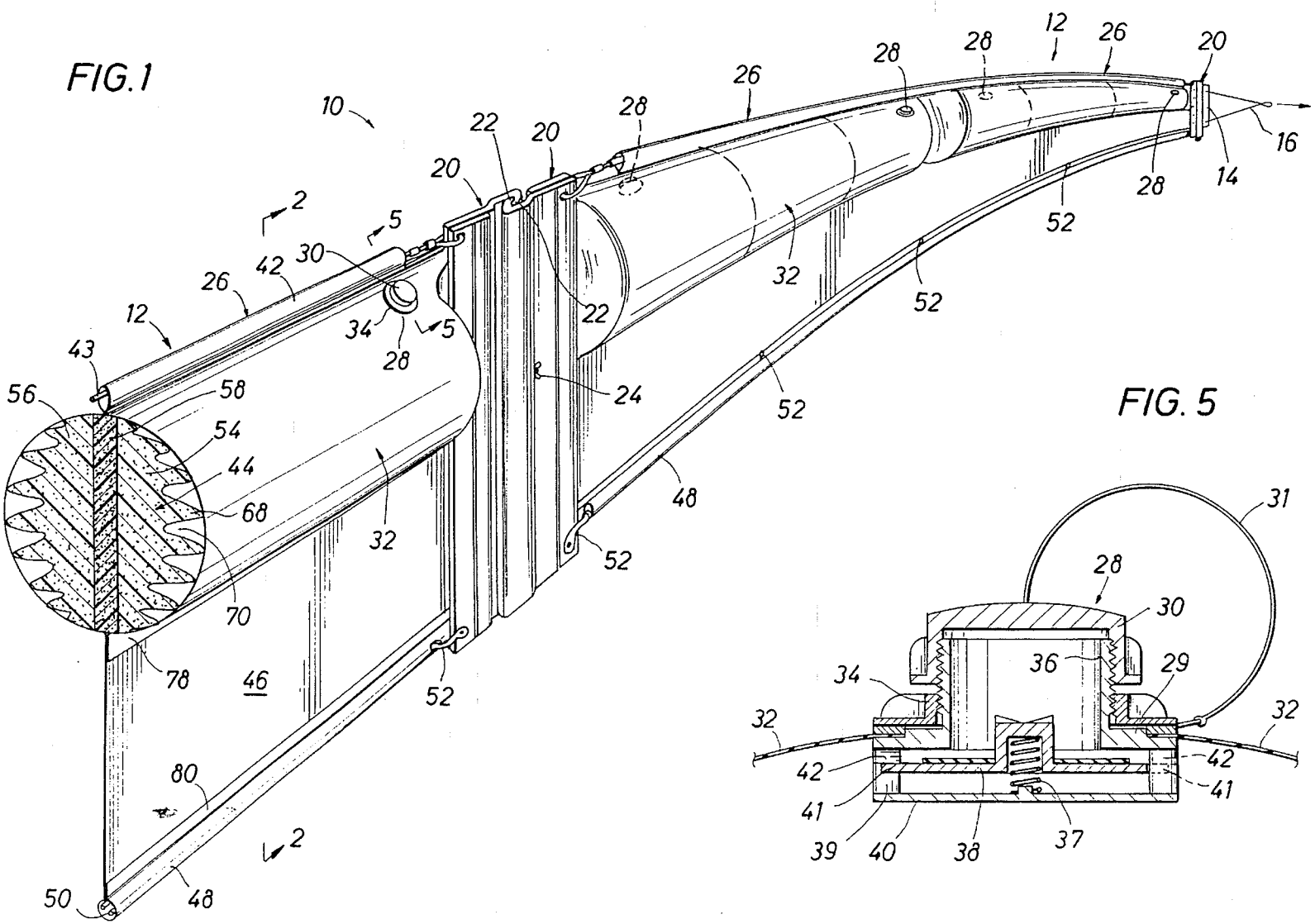
FIG. 1 is a perspective of a containment boom including a plurality of connected flotation units for the containment of oil or the like on a body of water in accordance with the present invention.
FIG. 5 is an enlarged section taken generally along line 5—5 of FIG. 1 and showing an air valve to permit supply and exhaust of air.

Referring now to the drawings for a better understanding of this invention, a self inflating containment boom is shown generally at 10 in FIG. 1. Such boom is adapted for floating on a body of water to contain oil or other containments. Boom 10 may be deployed from a boat or other floating facility. The boom 10 may also be deployed from a dock, or shore as will be explained below. Boom 10 includes a plurality of separate units or modules 12 connected end to end for forming a containment boom. An end unit 12 includes a tow bridle 14 connected thereto and a cable 16 connected to bridle 14 for removable connection to a boat tow for deployment of boom 10.

A connector generally indicated at 20 is mounted adjacent each end of each unit 12. It has an outer interlocking flange 22 adapted to fit within a mating flange 22 on adjacent connector 20. A screw 24 extends through the body of one of the interlocking connectors 20 and engages flange 22 of the other interfitting connector 20 to lock interfitting flanges 22.

Each unit 12 includes a plurality of flotation chambers shown generally at 26 with each chamber 26 having an outer water impermeable cover 32 and an air path to the interior of the cover 32. The air path includes an air valve 28 at each end thereof as shown in FIG. 5. Air valve 28 may be opened so as to close the air path from outside atmosphere to the interior of the cover 32, or it may be closed. Air valve 28 has a body 29 and a manually removable cap 30 on body 29 which may be unthreaded for opening of air valve 28. A retaining string member 31 having one end secured to body 29 and an opposed end secured to cap 30 prevents loss of cap 30 when unthreaded from body 29. A threaded lock nut 34 clamps body 29 to cover 32 about a suitable opening in cover 32.

Body 29 of an air valve 28 has a central bore 36. A spring 37 forces valve member 38 toward a seated position against body 29. Spaced posts 39 for lower cover 40 permit the flow of air between the interior of cover 32 and central bore 36. Valve member 38 may be releasably maintained in a open position by manually rotating valve member 38 a small amount such as 5 degrees so that extensions 41 on valve member 38 releasably fit beneath adjacent retaining tabs 42 on posts 39. Under some conditions, it may be desirable to have valve member 38 closed even with cap 30 in an open position. For this purpose, valve member 38 with cap 28 removed may be manually rotated by manually engaging the upper end of valve member 38 and rotating valve member 38 for disengagement of tabs 42 and extensions 41 so that valve member 38 moves to closed position under the influence of spring 37. Thus, even with cap 28 removed, valve member 38 may be easily moved between open and closed position manually. An air valve of the kind described above which has been found to be satisfactory with the boom 10 may be purchased under the name "Monsun XS Valve" from Monsun Sports and Plastic Products AB, of Alvangen, Sweden.

Figure 2:
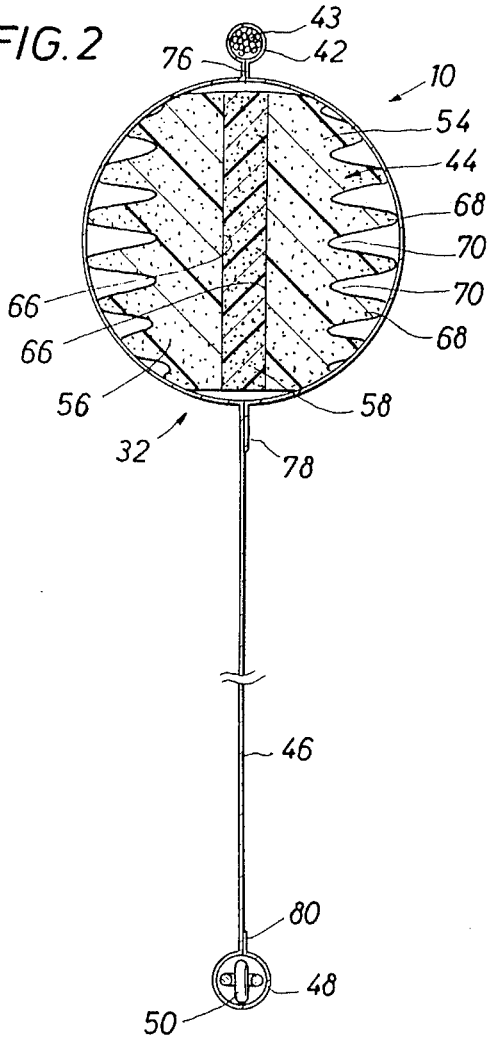
FIG. 2 is a section taken generally along line 2—2 of FIG. 1 which shows self-inflated flotation members for a boom.

FIG. 2 illustrates a cover or covering 32 of boom 10. Cover 32 is formed from a sheet of fabric which is sealed with a coating of polyvinylchloride on the two opposed outer facing surfaces to make covering 32 water impervious and air tight. Covering 32 is normally of a bright orange color in order that it may be easily visible. The fabric may be a scrim or loosely woven fabric formed of a polyester material. A urethane material may also be used if desired. An inhibitor may be added to inhibit ultraviolet light and marine growth.

Covering 32 includes an upper loop or pocket 42 which receives a tension cable 43 therein. Covering 32 extends about a flotation subassembly indicated generally at 44 and positioned within a space within by cover 32. Flotation subassembly 44 when self-inflated is compressed by covering 32 into a generally circular cross section. A skirt 46, preferably formed of the same material as cover 32, extends downwardly from flotation subassembly 44. A lower loop 48 of skirt 46 receives a chain 50 as ballast. Chain 48 is secured or anchored to a connector 20 by suitable shackles 52 (see FIG. 1). Upper loop 42, lower loop 48, and the open space of area formed within covering 32 for subassembly 44 are formed by heat sealing or R-F welding at a temperature of about 750° F.

Flotation assembly 44 includes a pair of spaced open cell outer flotation members 54, 56 separated by an intermediate water repellent buoyant flotation member 58. Open cell flotation members 54, 56 are preferably formed of an open cell polyurethane foam material having a density preferably about 1.70 lbs./cu.ft. A density between 1.60 lbs./cu.ft. and 1.80 lbs./cu.ft. is satisfactory to provide a desired porosity or cell size so that flotation members 54, 56 retain at least some buoyancy in the event that cover 32 is punctured or ruptured, and flotation members 54, 56 are exposed to and absorb water. Each flotation member 54, 56 has an inner planar face 66 and an outer face characterized by a plurality of protuberances 68 and intervening depressions 70. The outer face looks much like the protuberances and depressions of an egg carton. The outer face structure of flotation members 54, 56 is advantageous in that flotation members 54, 56 may be easily compressed by cover 32 into a desired circular cross sectional shape when self-inflated, or flattened for coiling about a reel or like for storage when air is exhausted. Protuberances 68 are of a generally conical shape; they extend at least about one (1) inch and preferably about two (2) inches from an adjacent outer face of flotation members 54, 56. A compressibility of about 50% from original volume is preferable for open cell flotation members 54, 56, although a compressibility of from about 25% to about 65% from original volume is satisfactory.

Figure 4:
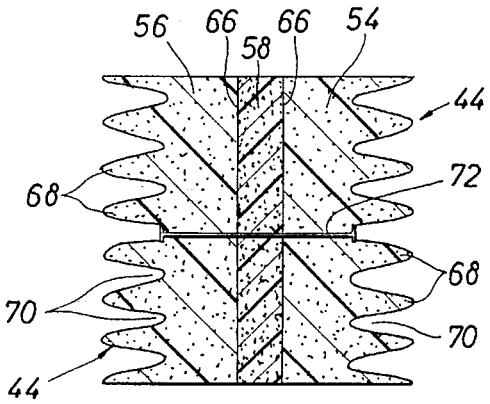
FIG. 4 is a cross section of a flotation subassembly in a fully expanded position prior to assembly with a cover and showing an intermediate water repellent flotation member secured to and fitting between a pair of open cell flotation members.

The density of the open cell urethane material determines the porosity or cell size. A high density of the material is characterized by small cell size. A lower density of the material is characterized by a large cell size. Cell size for the material of flotation members 54, 56 is selected as a compromise between a sufficiently large cell size for a relatively high buoyancy when the boom is self-inflated with air, and a sufficiently small cell size so that at least some buoyancy remains in flotation members 54 and 56 even when water is absorbed by the flotation members. An open cell polyethylene foam material has also been found to be satisfactory for flotation members 54, 56. Flotation members 54, 56 are relatively light weight and may be easily shaped to a desired cross section shape. A circular shape is preferred for a boom 10 due to its superior operating characteristic in rough seas. An approximate circular shape is achieved when the rectangular material of FIG. 4 is placed within cover 32 of FIG. 2 and when air is allowed to enter the interior of the cover. Projections 68 and intervening voids 70 also permit a low foam weight for a specific volume and furthermore provide a soft outer surface which can be easily gripped.

In order to provide an increase in buoyancy to subassembly 44, particularly when flotation members 54, 56 have absorbed water such as might occur when cover 32 is punctured, an intermediate water impervious buoyant flotation member 58 is positioned between opposed faces 66 of open cell flotation members 54, 56. Intermediate flotation member 58 is preferably formed of a closed cell foam material, preferably closed cell polyethylene. A closed cell polypropelene material has also been found to be satisfactory. Intermediate flotation member 58 should be of a size in coordination with the open cell flotation members 54, 56 to prevent sinking of the boom 10 when cover 32 is punctured and water enters the interior of cover 32 and into the open cells of members 54, 56.

An intermediate flotation member 58 is secured to flotation members 54 and 56 by spaced plastic ties 72 (FIG. 4) having T-shaped ends to secure plastic ties 72 to the adjacent outer surfaces of flotation members 54 and 56 as shown in FIG. 4. Ties 72 may be inserted by a suitable gun which propels ties 72 through flotation members 54, 56. Intermediate flotation member 58 is generally rectangular in cross section. It is preferably about one-half inch or less in thickness so that flotation member 58 is sufficiently flexible for winding of a boom 10 onto a reel or the like.

As shown in FIG. 1, a boom unit 12 is provided between a pair of connectors 20. Each boom unit 12 preferably includes a pair of connected chambers 26. A chamber 26 may, for example, be about 25 feet in length. Any number of chambers 26 could be provided between connectors 20, but a total boom unit length of about 100 feet is preferred from an ease of handling consideration. Accordingly, four chambers 26 of a boom unit 12 are preferred.

Figure 3:
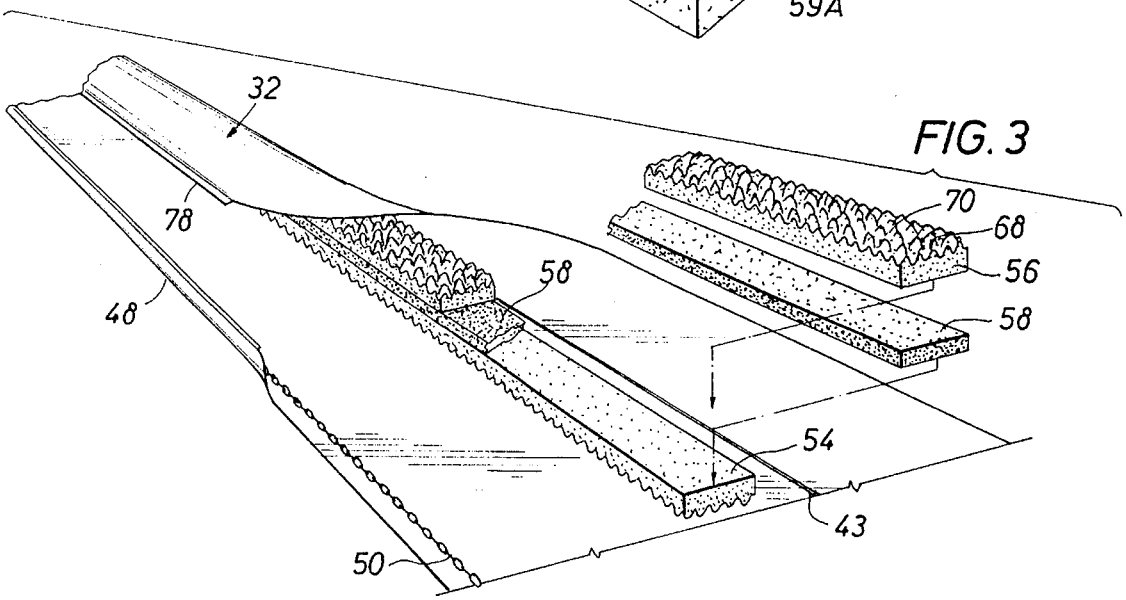
FIG. 3 is an exploded view of a boom showing flotation members and an outer cover being positioned about flotation members for assembly of a boom.

For assembly of a boom unit 12 see FIGS. 2 and 3. A cable 43 is positioned on covering 32. A loop 42 is formed about cable 43 and R.F. welded at 76. Flotation members 54, 56 are normally arranged in 8 foot lengths on opposed sides of an intermediate flotation member 58 which extends for the entire length of chamber 26. Flotation member 58 should be oriented in alignment with skirt 46 below and cable 43 above to provide proper flotation of chamber 26 if water should invade covering 32, while the boom 10 is in service.

Three lengths of open cell flotation members 54, 56, each 8 feet in length, are positioned on an intermediate flotation strip 58 and secured thereto by a plurality of suitable plastic ties 72 (or by other suitable means such as tape) to form flotation subassembly 44. Then, covering 32 is folded over subassembly 44 and heat sealed or R.F. welded at 78 for enclosing subassembly 44. Next, loop 48 on the lower edge of covering 32 is rolled over chain 50 and heat or R.F. welded at 80. Covering 32 extends for the entire length of boom unit 12 between a pair of end connectors 20.

Boom 10 may be several hundred feet in length. It may be stored on a reel such as that illustrated in FIG. 6 at 84 which is preferably driven by a suitable motor (not shown). Reel 84 may, if desired, be rotated manually. One end of boom 10 is secured to horizontal rotational axis 88 on reel 84. Reel 84 is then rotated with boom 10 being manually fed onto reel 84 with air valves 28 in an open position. Air escapes the boom via valves 28, because air of open cell flotation members 54, 56 is mechanically forced out of such cells by the compression force on boom 10 as it is wound on reel 84. Flotation members 54, 56 are flattened or compressed by contact with outer covering 32 when coiled onto reel 84 thereby permitting storage of boom 10 in a relatively small space.

Air valves 28 are placed in an open position to permit exhaust of air from each section 26 for flattening of flotation members 54, 56. Air valves 28 are closed for boom storage. When boom 10 is unreeled from reel 84, air valves are opened so that air flows inside flotation members 54, 56 thereby filling of the open cells of flotation members 54, 56. Inflation is automatic; that is, the boom self inflates as it is unreeled from reel 84 as shown in FIG. 6 or restraining material is released from a coiled boom as shown in FIG. 7.

FIGS. 7 and 8 show boom 10 coiled into a coiled package 90 for storage and shipment. A suitable restraint such as a rope or belt 92 is tied about package 90 to secure package 90 in coiled position. A suitable transparent plastic cover 94, such as a polyethylene sheet, may be positioned about package 90 and sealed. Advantageously, boom packages 90 of a predetermined length of boom may be stored in a suitable location for deployment in the event of emergencies or the like.

FIG. 8 illustrates deployment of boom 10 in water. Outer cover 94 and restraint 92 are removed at the body of water in which boom 10 is desired to be deployed. With air valves 28 open, boom 10 self-inflates as it uncoils for easy positioning in the desired area on a body of water.

Figure 9:
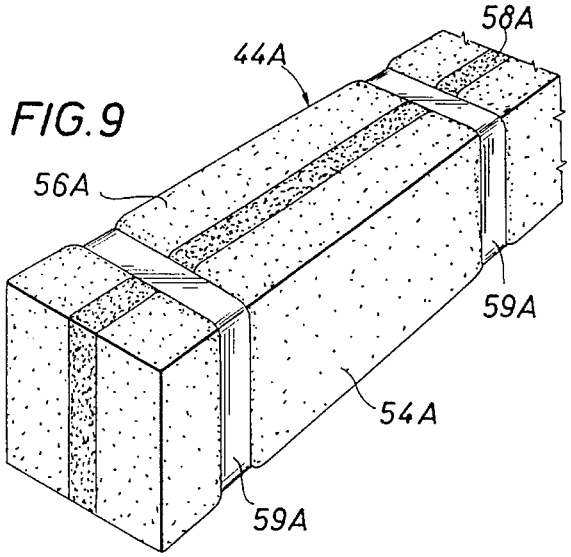
FIG. 9 is a perspective of an alternative embodiment of a self-inflatable flotation subassembly showing a pair of outer open cell flotation members of a rectangular cross section with a water impermeable flotation member positioned therebetween and secured together with a plastic adhesive tape.

FIG. 9 illustrates an alternative flotation assembly in which a separate subassembly 44A has a pair of opposed open cell flotation members 54A, 56A of rectangular cross section positioned on opposed sides of an intermediate closed cell flotation member 58A. Flotation members 54A, 56A are secured to intermediate flotation member 58A by suitable strips of tape 59A at selected intervals along the length of subassembly 52A. Subassembly 44A may be used in a similar manner as subassembly 44 in the embodiment shown in FIGS. 1–8. It is formed of similar materials to those of subassembly 44.

Various modifications of the boom described above may be apparent to those skilled in the art. Accordingly, it is desired that this invention not be limited to the embodiments disclosed herein, but is to be limited only as defined by the attached claims.

What is claimed is:

1. An air inflatable flotation structure for a containment boom comprising:

an outer water resistant covering defining an inner space;

a pair of self-inflatable flotation members within said inner space positioned in side-by-side spaced relation and formed of an open cell foam material;

a water repellent flotation member positioned within said inner space between said pair of flotation members to provide increased buoyancy to said self-inflatable flotation member; and an air valve in communication with said self-inflatable flotation members mounted on said outer water resistant covering and movable between open and closed positions, said air valve when in open position permitting flow of air between atmosphere and the inner space defined by said covering to permit inflation and expansion of said pair of flotation members.

2. An air inflatable flotation structure for a containment boom as set forth in claim 1 wherein:

said pair of flotation members are generally similar in shape and are compressed by said outer covering when said outer covering is compressed against said flotation members upon being rolled in a coiled relation for flattening of said flotation structure.

3. An air inflatable flotation structure as set forth in claim 2 wherein:

said pair of flotation members are self-inflated when said air valve is in an open position upon uncoiling of said outer covering from a flattened position for expansion of said pair of flotation members against an inner surface of said covering.

4. An air inflatable flotation structure as set forth in claim 1 wherein:

a skirt is secured to said outer covering and extends downwardly from said flotation members when said flotation structure is positioned on a body of water for containment; and ballast is carried by said skirt to maintain said flotation structure in a desired relation on the body of water.

5. An air inflatable flotation structure as set forth in claim 1 wherein:

said water repellent flotation member is formed of a closed cell foam material and is flexible for coiling and uncoiling of said flotation structure.

6. An air inflatable flotation structure as set forth in claim 1 wherein:

said pair of self-inflatable flotation members are generally similar in shape each having an inner planar surface and an outer surface formed of a plurality of protuberances of a generally conical shape.

7. An air inflatable flotation structure of claim 4 wherein:

said water repellant flotation member is positioned in alignment with said skirt, such that said water repellant flotation member is approximately vertically positioned within said flotation structure when said section is deployed on said body of water.

8. A containment boom comprising:

a plurality of barrier units coupled together end to end in a predetermined string formation; each of said units including a self air inflatable chamber capable of being wound on a reel and deployed therefrom; each self air inflatable chamber comprising:

an outer water resistant covering defining an inner space;

a pair of self-inflatable flotation members within said inner space positioned in side-by-side spaced relation and formed of an open cell foam material;

a water repellent flotation member between said self-inflatable flotation members; and an air valve in communication with said self-inflatable flotation members mounted on said outer water resistant covering and movable between open and closed positions, said air valve when in an open position permitting flow of air between atmosphere and the inner space defined by said covering to permit inflation and expansion of said self-inflatable flotation members, said air valve when in open position permitting exhaust of air from said self-inflatable flotation members for flattening of said boom for winding into a coil.

9. A containment boom as set forth in claim 8 wherein:

said water repellent flotation member is generally rectangular in cross section and relatively thin to facilitate winding onto a reel or into a coil for storage and to facilitate unwinding when deployed.

10. A containment boom as set forth in claim 8 wherein:

said pair of self-inflatable flotation members are generally similar in shape and may be compressed by said outer covering when said outer covering is compressed against said flotation members upon being rolled into a coil.

11. A containment boom as set forth in claim 9 wherein:

said pair of self-inflatable flotation members self-inflate when said air valve is in an open position and air enters said inner space.

12. A containment boom as set forth in claim 8 wherein:

said water repellent flotation member is formed of a closed cell foam material and is flexible for coiling and uncoiling of said flotation chamber.

13. A containment boom as set forth in claim 8 wherein:

said pair of flotation members are generally similar in shape each having an inner planar surface and an outer surface formed of a plurality of protuberances of a generally conical shape.

14. A containment boom as set forth in claim 8 further comprising:

securement means for securing said self-inflatable flotation members and said water repellent flotation members to each other thereby forming a subassembly within said inner space.

15. A containment boom as set forth in claim 14 wherein:

said securement means includes a plurality of spaced elongate pin-like members extending through said flotation members and said water repellent flotation member for securing said members together.

16. A containment boom as set forth in claim 14 wherein:

said securement means includes a plurality of adhesive straps extending about said subassembly and spaced along the length thereof for securing said self-inflatable flotation members and said water repellent flotation member to each other.

17. A method for forming a self-inflatable flotation section for a containment boom comprising the steps of:

providing an outer water resistant covering defining an inner space and having an air path communicating with said inner space;

forming a flotation subassembly including a pair of open cell flotation members separated by a closed cell water repellent flotation member and secured together to define said subassembly; and inserting said subassembly within said inner space defined by said covering so that air via said air path permits expansion of said open cell flotation members against said covering when said covering is unrestrained.

18. The method as defined in claim 16 further characterized by the step of:

compressing said self-inflatable flotation section so that said air is expelled from said open cell flotation members for storage of said containment boom.

* * * * *